US005699839A

United States Patent [19]

Dehne

[11] Patent Number: 5,699,839

[45] Date of Patent: Dec. 23, 1997

[54] ZERO-VENT LIQUID NATURAL GAS FUELING STATION

[75] Inventor: Hans-Joachim Dehne, Los Altos, Calif.

[73] Assignee: Acurex Environmental Corporation, Mountain View, Calif.

[21] Appl. No.: 502,678

[22] Filed: Jul. 14, 1995

[51] Int. Cl.[6] ..... F17C 13/00

[52] U.S. Cl. ..... 141/248; 141/2; 141/5; 141/7; 141/18; 141/59; 141/67; 62/7; 62/50.1

[58] Field of Search ..... 141/2–5, 7, 18, 141/21, 59, 67, 248; 62/7, 50.1, 50.6, 50.7

[56] References Cited

U.S. PATENT DOCUMENTS

| | | | |
|---|---|---|---|
| 2,224,963 | 12/1940 | Hooper et al. | 62/50.1 |
| 2,487,863 | 11/1949 | Garretson | 62/50.1 |
| 2,854,826 | 10/1958 | Johnston | 141/5 X |
| 3,016,928 | 1/1962 | Brandt | 141/59 X |
| 3,079,760 | 3/1963 | Maher | 62/50.1 |
| 3,241,580 | 3/1966 | Lichtenberger et al. | 141/5 |
| 3,303,661 | 2/1967 | Karbosky | 62/55 |
| 3,760,597 | 9/1973 | Becker | 62/50.1 X |
| 3,837,377 | 9/1974 | McJones | 141/4 |
| 5,107,906 | 4/1992 | Swenson et al. | 141/11 |
| 5,121,609 | 6/1992 | Cieslukowski | 62/50.4 |
| 5,231,838 | 8/1993 | Cieslukowski | 62/50.4 |
| 5,325,884 | 7/1994 | Mirel et al. | 137/110 |
| 5,329,777 | 7/1994 | Weltmer, Jr. | 62/49.2 |
| 5,360,139 | 11/1994 | Goode | 222/40 |
| 5,365,981 | 11/1994 | Peschka et al. | 141/7 |
| 5,409,046 | 4/1995 | Swenson et al. | 141/4 X |
| 5,421,160 | 6/1995 | Gustafson et al. | 62/7 |

*Primary Examiner*—J. Casimer Jacyna
*Attorney, Agent, or Firm*—Fish & Richardson P.C.

[57] ABSTRACT

A liquefied natural gas (LNG) fueling station which does not vent natural gas vapors. Three cryogenic storage vessels alternately serve as dispensing, conditioning, and receiving vessels. A natural gas compressor transfers vapor between the vessels and evacuates vapors vented from tanker trucks and vehicles. Heat absorbed by the LNG is utilized to warm the fuel for use in vehicles by bubbling the vapors through the LNG in the conditioning vessel.

13 Claims, 4 Drawing Sheets

ZERO-VENT LIQUID NATURAL GAS FUELING STATION

BACKGROUND OF THE INVENTION

The present invention relates generally to liquid natural gas fueling stations, and more particularly to liquid natural gas fueling stations that recover vapors generated during fueling operations.

As a vehicle fuel, natural gas could be used either in liquid form, or in a compressed gaseous form. Compressed natural gas (CNG) requires large high-pressure storage vessels operating at up to 3,000 psig to be mounted in vehicles. On the other hand, liquid natural gas (LNG) requires storage vessels operating only at 200 psig or less, and because LNG has a higher fuel density than CNG, vehicles powered by LNG have a longer range between refuelings. Consequently, LNG is suited to become a main alternative vehicle fuel.

Persistent difficulties with LNG include the loss of LNG which is often vented to the atmosphere and the cost of refrigeration or reliquifaction. The temperature of LNG may be measured by its saturation or usage pressure, which can be used to maintain the bulk LNG in liquid form. As the temperature of the LNG increases, the saturation pressure of the LNG increases and the density of the LNG decreases. Since natural gas liquefies at −260° F. (at atmospheric pressure), heat leaks into the LNG, and, unless checked, the amount of vapor pressure can eventually surpass the maximum pressure of the storage vessel. It must therefore be vented.

The main exposure of LNG to heat energy occurs during transport from the liquefying station to the fueling station, during filling operations, during storage in the fueling station, and during fueling operations. There are two methods to deal with the heat gain of the LNG and avoid rupture of the storage vessel. First, the LNG may be refrigerated or the vapor recondensed, both of which require an input of energy. Second, the natural gas vapor may be vented to the atmosphere or to a natural gas pipeline, which is wasteful.

Even in vacuum insulated pressure vessels, one-quarter to one percent of the LNG vessel capacity may evaporate each day. In the piping and auxiliary equipment the rate of evaporation is even higher. To minimize these losses, the LNG must be transferred to a vehicle quickly from the LNG supplier, which forces operators of vehicle fleets and fueling stations to coordinate fueling and supply to maintain "just-in-time" inventory control.

Although LNG tanker trucks typically transport subcooled LNG, i.e., LNG that is cooled below saturation pressure, at atmospheric pressure, in tanks designed for a maximum operating pressure of 75 pounds per square inch gauge (psig), inefficiency occurs when fuel is transfered from a tanker truck to the fueling station. To transfer the LNG from the tanker truck to a vessel in the fueling station by pressure transfer, the pressure in the vessel must be lower than the pressure in the truck tank. When the tanker truck arrives at the fueling station, the truck tank is pressurized to forty to fifty psig by an evaporator which is part of the truck equipment. A nearly empty vessel at the fueling station is typically at a pressure of fifty to one-hundred psig. Therefore, the vapor in the storage vessel must either be vented or recondensed before filling to reduce the pressure in the storage vessel.

As for LNG vehicle tank configurations, there are several approaches. One approach is to maintain the LNG in the vehicle tank at subcooled temperatures, but subcooled LNG in the vehicle tank must be pumped to the engine by an expensive and often unreliable cryogenic pump. Therefore, another approach is to thermally "condition" and warm the LNG prior to transfer to the vehicle tank, which avoids the use of a cryogenic pump, but requires extra space in the vehicle tank.

Transfer the LNG from the fueling station vessel to the vehicle tank is also often accomplished by pressure transfer. Therefore, the pressure in the fueling station dispensing vessel should be made greater than the pressure in the vehicle tank.

An additional inefficiency is the loss of natural gas vapors from the vehicle which utilizes the fuel. When an LNG vessel equipped vehicle has been parked for a prolonged period of time, the gradual heat gain can build pressure in the vehicle tank beyond the typical rating pressure of two-hundred psig. In this case, it is usually necessary to vent the vapor.

It is an object of the present invention to provide a LNG fueling station which recovers vent gasses from all sources of loss, i.e., a zero-vent fueling station, without refrigeration or reliqufaction capability.

It is another object of the present invention to loosen the restrictions on LNG fueling station just-in-time inventory control.

It is yet another object of the present invention to use the natural tendency of LNG to warm to thermally condition the LNG for fueling vehicles.

It is still another object of the present invention to use the heat in vent gasses from vehicles and tankers to thermally condition the LNG.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the claims.

SUMMARY OF THE INVENTION

A method of the present invention is directed to a liquid natural gas fueling station with first, second, and third cyrogenic storage vessels. The first vessel contains natural gas vapor and the second and third vessels contain liquid natural gas. The vapor pressure in the first vessel is lowered by extracting natural gas vapor therefrom, which also lowers the temperature of liquid natural gas, if present. The extracted vapor is conducted into either the second vessel to pressurize the second vessel, or into the liquid in the third vessel. Liquid natural gas is introduced into the first vessel, and liquid natural gas is dispensed from the second vessel. The steps are repeated, using the second vessel in place of the first, the first vessel in place of the third, and the third vessel in place of the second.

BRIEF DESCRIPTION OF THE DRAWING

The accompanying drawings, which are incorporated in and constitute a part of the specification, schematically illustrate a preferred embodiment of the invention, and together with the general description given above and the detailed description given below, serve to explain the principles of the invention.

DESCRIPTION OF THE PREFERRED EMBODIMENTS

A preferred embodiment of the the method of the present invention is exemplified schematically in FIGS. 1A–1E. According to the present invention, heat accumulated by the LNG during the various stages of operation is used to thermally condition the fuel for use in vehicles. In addition, the method of the present invention conserves fuel by recovering and reliquefying natural gas vapors from vehicles and tanker trucks.

The present invention operates in a cycle, the steps of which are shown in FIGS. 1A–1E. In the preferred embodiment, three vessels 10, 20, 30 are used to hold LNG. However, the invention may be operated with more than three vessels. Also, one of the vessels may be replaced by a line from a natural gas utility or CNG compressor station. The three vessels 10, 20, 30 serve alternately as dispensing, conditioning, and receiving vessels, as described below. During a single cycle, LNG fuel from tanker trucks is placed in the receiving vessel, vehicles are fueled from the dispensing vessel, and heat is transferred from the vent gasses from tankers, vehicles, and the receiving vessel to the conditioning vessel. At the end of the cycle, the functions of the vessels "shuttle" so that the empty dispensing vessel becomes the new receiving vessel, the receiving vessel becomes the new conditioning vessel, and the conditioning vessel becomes the new dispensing vessel.

Figure 1A:
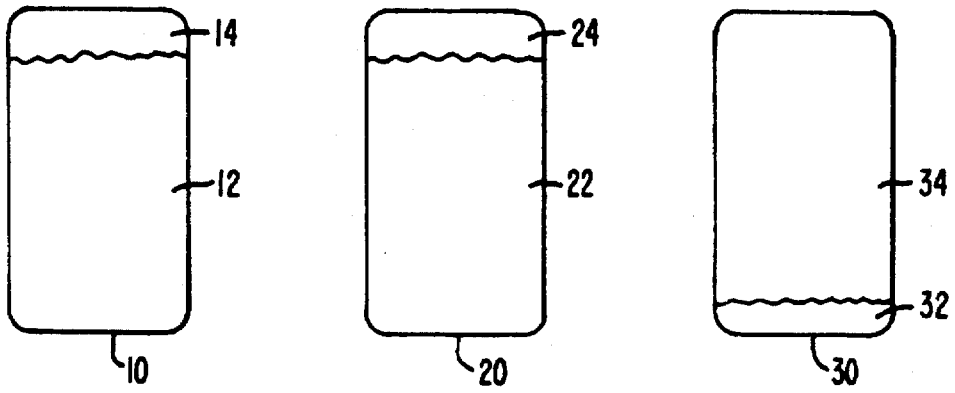
FIG. 1A is a schematic diagram of the fueling station vessels at the beginning of the cycle of the method of present invention.

A typical operating condition at the beginning (or end) of a cycle is shown in FIG. 1A. Vessels 10 and 20 are nearly full, whereas vessel 30 (previously used to fuel vehicles) is empty or nearly empty. Vessel 10 generally begins with warm LNG 12 and mid-pressure vapor 14. The LNG 12 in vessel 10 will be at a saturation pressure of fifty to one-hundred psig. The pressure of vapor 14 in vessel 10 will be equal to the saturation pressure of liquid 12. Vessel 20 begins with cool LNG 22 and low pressure vapor 24. LNG 22 will be at a saturation pressure between twenty to thirty psig, and vapor 24 will be also be equal to the saturation pressure of liquid 22 or slightly higher. Vessel 30 begins with high pressure vapor 34 at a transfer pressure of fifty to one-hundred, and possibly even two-hundred psig. Vessel 30 might begin with no LNG, or it may contain a small amount of warm LNG 32, at a saturation pressure of fifty to sixty psig or even higher. These values are exemplary, and will depend on the amount of heat absorbed by the LNG during the various stages of operation, and the exact requirements of tanker trucks and vehicles associated with the station.

Figure 1B:
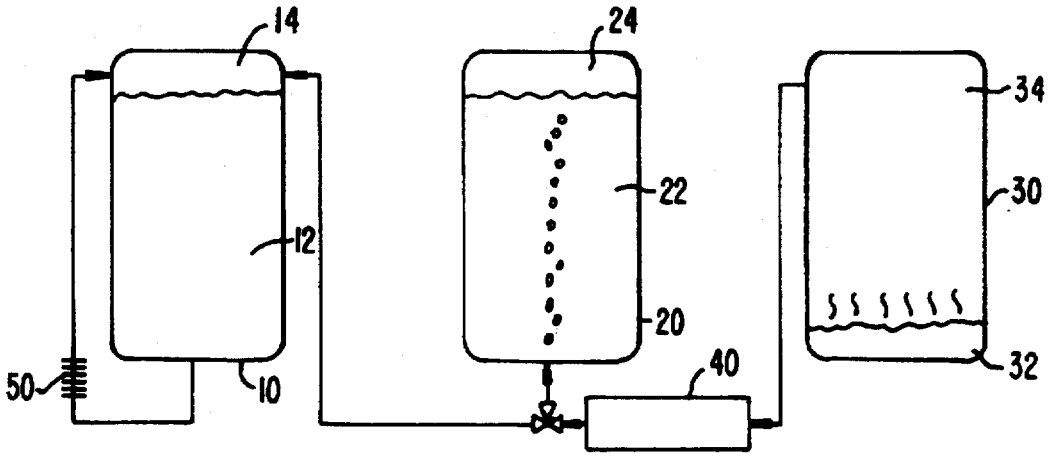
FIG. 1B is a schematic diagram of the fueling station vessels in the resetting step.

Turning now to FIG. 1B, vessel 30 is prepared to receive LNG from a tanker while vessel 10 is prepared to dispense LNG. A natural gas compressor 40 draws vapor from receiving vessel 30. This causes the pressure of vapor 34 to drop and the LNG 32 to boil and cool. Compressor 40 withdraws vapor from receiving vessel 30 until the pressure of vapor 34 is sufficiently low to permit pressure transfer from a tanker truck. In particular, the pressure of vapor 34 should be less than fifty psig, and more preferably the pressure should be about fifteen psig. Similarly, the LNG 32 will be cooled to a saturation pressure of about twenty to thirty psig.

Vapor drawn by compressor 40 from receiving vessel 30 is first used to pressurize dispensing vessel 10. Vapor 14 in dispensing vessel 10 is pressurized to a full pressure of 175 to 200 psig. Once dispensing vessel 10 is at full pressure, vapor from receiving vessel 30 is routed to bubble through LNG 22 in conditioning vessel 20. LNG 22 absorbs the heat so that the saturation pressure of LNG 22 increases and vessel 20 may function as a dispensing vessel in the next cycle.

Figure 1C:
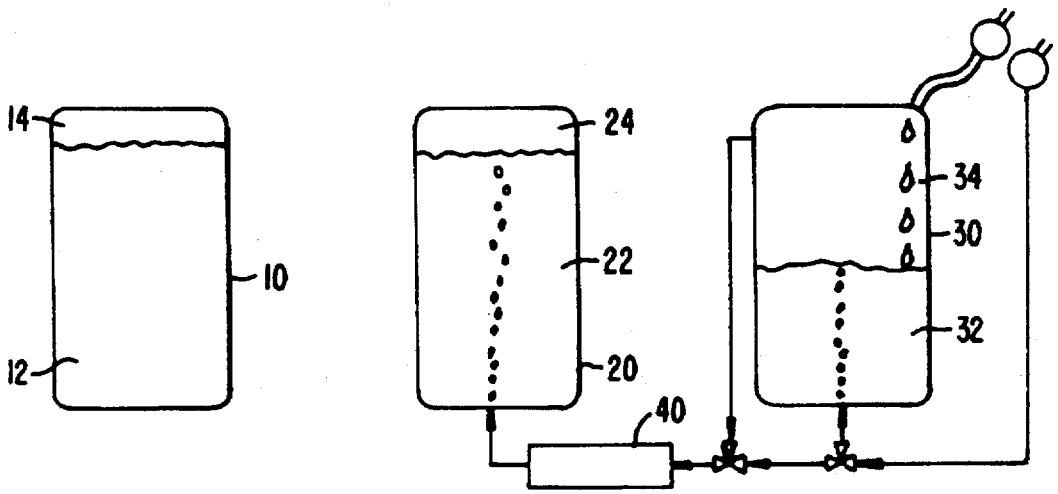
FIG. 1C is a schematic diagram of the fueling station vessels in the step of receiving fuel from a tanker truck.

The step of receiving LNG fuel from a tanker is shown in FIG. 1C. Although in the preferred embodiment, the tanker is a tanker truck, the invention is not so limited. Any sort of transport vehicle could be used to carry LNG fuel to the fueling station of the present invention, and a tanker is used herein as a generic term. A line is connected to the tanker from receiving vessel 30. Because the vapor pressure in receiving vessel 30 has been lowered, the receiving vessel 30 can be filled with LNG by pressure transfer from a tanker. After fueling is complete, natural gas vapor is drawn from the tanker by compressor 40 and bubbled through LNG 22 in conditioning tank 20. If the receiving vessel 30 is not full, and additional tanker trucks are expected, vapor may be drawn by compressor 40 from vessel 30 to keep the pressure of vapor 34 low. However, if conditioning vessel 20 is warm enough, and receiving vessel 30 is full, then the gas from the tanker may be bubbled through LNG 32 directly.

Figure 1D:
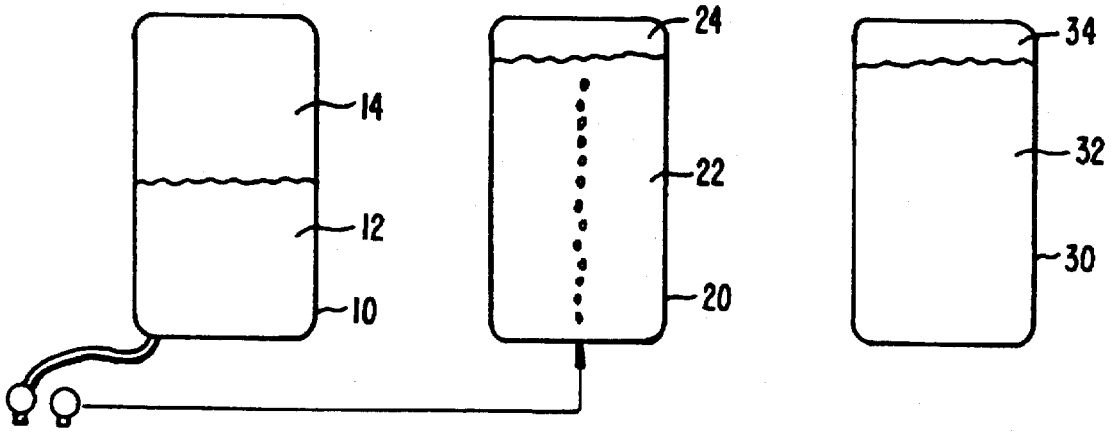
FIG. 1D is a schematic diagram of the fueling station vessels in the step of fueling a vessel.

The step of dispensing fuel to vehicles is shown in FIG. 1D. A line is run from dispensing vessel 10 to a vehicle. Because the vapor pressure in dispensing vessel 10 has been raised, the vehicle tank can be filled by pressure transfer.

In some cases it will not be necessary to vent warm vapor from the vehicle tank. Most LNG vehicles tanks are designed to spray the cold LNG from dispensing vessel 10 into the top of the vehicle tank so that the high-temperature vapor in the vehicle cools and condenses. Therefore, no venting will be required if the initial pressure in the vehicle tank is sufficiently reduced by this process. However, some LNG vehicles are designed for bottom filling of the vehicle tank, and sometimes the pressure of vapor is too high for condensation to occur. In these cases, rather than venting the warm natural gas vapor into the atmosphere, the vapors from the vehicle tank is vented through an additional line and bubbled through LNG 22 in conditioning vessel 20.

Figure 1E:
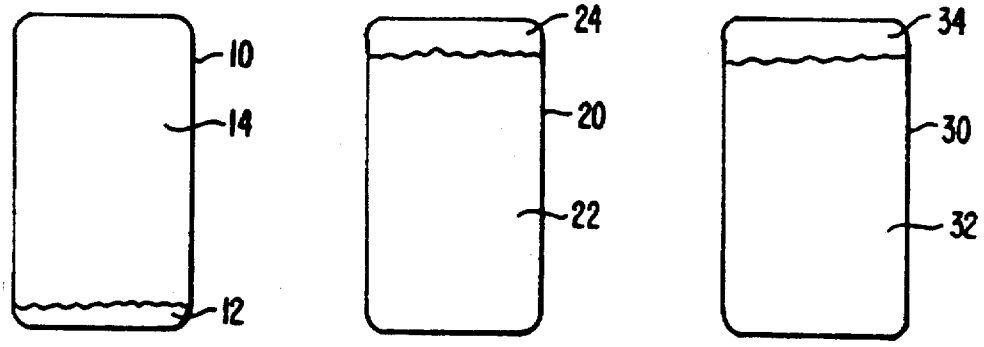
FIG. 1E is a schematic diagram of the fueling station vessels at the end of the cycle of the method of present invention.

By the end of the cycle, as illustrated by FIG. 1E, the receiving vessel 30 has been filled, and dispensing vessel 10 has been emptied. During the cycle, the LNG 22 in condition vessel 20 has been gradually heated by ambient heating, by vent gases from vehicles, by vent gases from tankers, and by gas extracted from receiving tank 30. It is preferred that by the end of the cycle, the temperature of the LNG 22 has risen from a saturation pressure of about twenty psig to a saturation pressure of fifty to one-hundred psig. The pressure transfer gas from dispensing vessel 10 can now be lowered by passing it through liquid 22 for recondensing. This will lower the pressure in vessel 10 to the saturation pressure of liquid 22 plus static head.

The functions of the vessels may now be shuttled, so that vessel 10 becomes the receiving vessel, vessel 20 becomes the dispensing vessel, and vessel 30 becomes the conditioning vessel. As described with reference to FIG. 1B, vapor is drawn from vessel 10 and used to pressurize vessel 20, or is bubbled through vessel 30. When vessel 20 is emptied, the functions are shuttled again, so that vessel 10 becomes the conditioning vessel, vessel 20 becomes the receiving vessel, and vessel 30 becomes the dispensing vessel.

Thus, in the method of the present invention, the conditioning vessel acts as a heat sink when a dispensing vessel is cooled to serve as a receiving vessel or when vapors vented by vehicles and tankers are liquefied. This "thermal conditioning" raises the temperature of the LNG from the cold state in which it was received from a tanker to a warm state to fuel a vehicle which does not use a cyrogenic pump.

Start-up operations may need to be performed when a fueling station is used for the first time. Before the fueling station begins operation, there is a large amount of heat in the components of the fueling station. Therefore, an operator might partially fill each tank with liquid nitrogen or some other cryogen to absorb the ambient heat.

Although FIGS. 1A–1E show the invention carried out with three vessels, additional vessels may be used to increase the capacity of the fueling station. In such a case, the cycle could be modified so that multiple vessels serve as conditioning vessels. Also, the present invention could be carried out with two vessels and a CNG compressor station line or a natural gas utility line. In a two vessel system, the vessels shuttle between a dispensing and a conditioning function.

The size and number of vessels will depend on the expected fuel demand from the station, with fewer and smaller tanks for low demand stations. The throughput of the fuel through the facility may be increased by "forcing" the conditioning of the LNG. Instead of relying solely on the heat energy acquired by normal operations to thermally condition the LNG in the receiving tank, the LNG in one vessel may be heated by evaporating LNG with a pressure building coil, drawing the vapor through compressor 40, and bubbling the vapor into the vessel to be conditioned.

Figure 2:
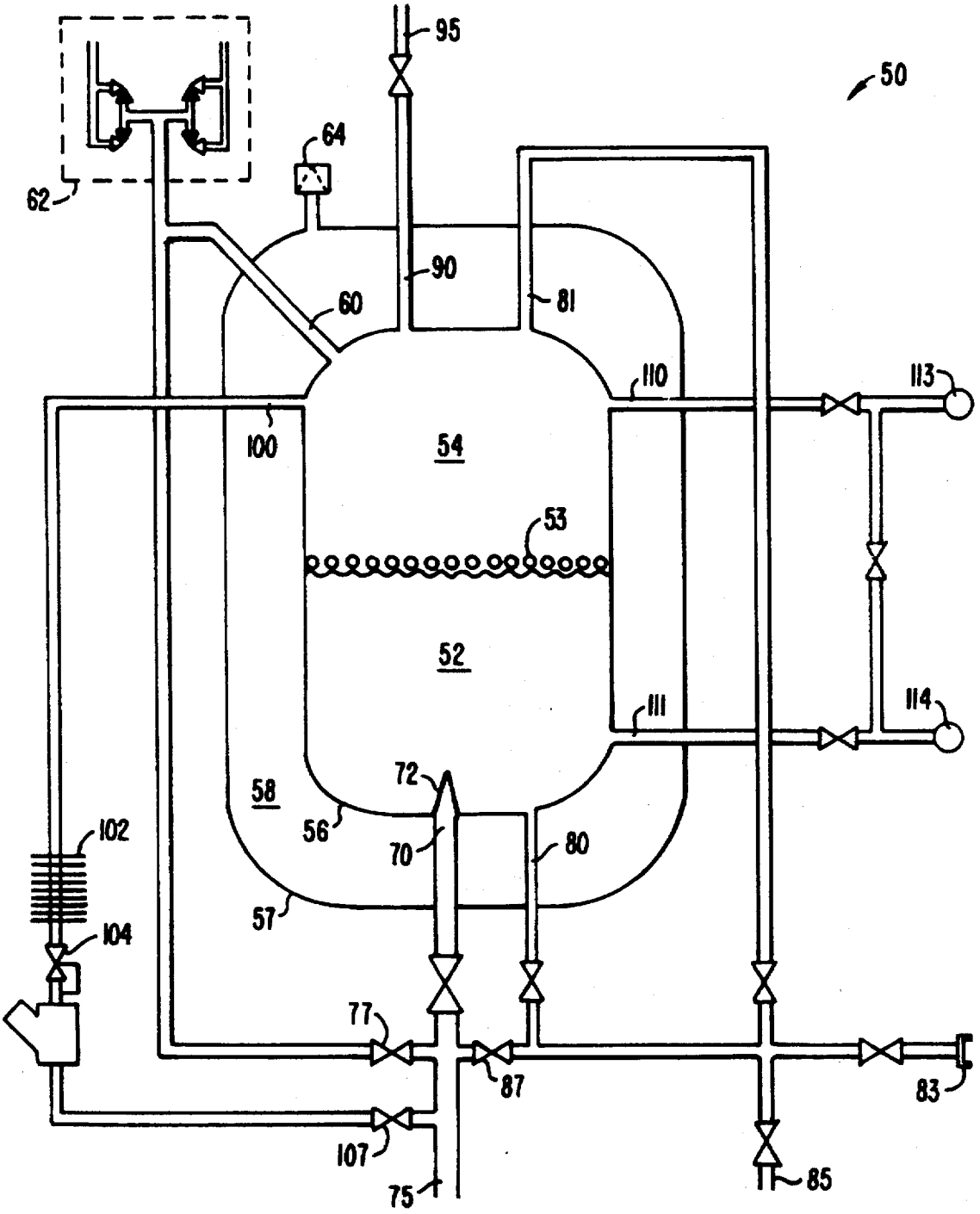
FIG. 2 is a schematic illustration of a single LNG storage vessel in the fueling station of the present invention.

The details of the vessels will be explained with reference to FIG. 2 which schematically illustrates vessel 50. Vessel 50 is a vacuum insulated cryogenic storage vessel constructed according to known practices to minimize the heat gained by the stored fuel.

Cryogenic storage vessel 50 is preferably of a double wall vacuum insulated construction. The vessel 50 has an inner vessel 56 and an outer vessel 57 separated by an evacuated space 58. The outer vessel 57 is free to expand relative to the inner vessel 56 to minimize thermal stress. Although not shown in the diagram, pipes are typically routed on the inside of the evacuated space 58, attached to inner vessel 56, and routed to the bulkhead (not shown). The preferred orientation of the vessel 50 is vertical because vertical tanks exhibit lower energy gains as compared to horizontal tanks.

Inner vessel 56 stores LNG 52 and natural gas vapor 54. Typically, a layer of insulating spheres 53 floats on LNG 52 to covers the entire surface of the liquid. The spheres are typically one to four inches in diameter, and form an insulating layer to minimize the evaporation of the LNG 52 as well as condensation of pressurization gases.

Vessel 50 has a number of ports. Each of the ports described below has associated unlabeled valves and piping. Each vessel 50 is equipped with a top safety port 60 connected to a duel safety valve system 62. Vessel 50 also has a rupture disk manifold 64. Vessel 50 is designed for a pressure capacity greater than the pressure required for fueling vehicles by pressure transfer. It is preferred that vessel 50 be designed with a pressure capability of two-hundred and fifty psig.

LNG is dispensed from liquid withdraw port 70. Liquid withdraw port 70 will be covered with a screen basket 72 to prevent spheres 53 from entering the piping when LNG is dispensed. Liquid withdraw port 70 is connected to a dispensing manifold 75. The dispensing manifold 75 may be connected to the safety valve system 62 through valve 77.

Vessel 50 has a bottom fill port 80 and a top fill port 81. The fill ports 80, 81 are connected to a coupling 83 which may be attached to a tanker truck to receive LNG. Preferably, top fill port 81 is used when vessel 50 receives LNG. Fill ports 80, 81 are also connected to a gas manifold 85. This allows the bottom fill port 80 to be used to bubble natural gas vapor into vessel 50, as previously described with reference to FIGS. 1B–1D. The fill ports 80, 81 may also be connected to dispensing manifold 75 through valve 87.

A top vent port 90 is connected to a gas manifold 95 to withdraw natural gas vapors, as described with reference to FIG. 1B.

Each vessel 50 has a top vapor entry port 100 connected to the outlet of an evaporator 102. The evaporator 102 permits pressurization of the storage vessel for maintenance functions and to maintain a minimum pressure of fifteen psig in the vessel 50. The input of evaporator 102 is connected to liquid withdraw line 75 by a pressure control valve 104 and valve 107. Together, the evaporator 102 and pressure control valve 104 act as a pressure building heat exchanger. The pressure building heat exchanger may be constructed according to standard practices in the art.

Two metering ports, 110, 111, provide access for pressure gages or transducers 113, 114 to determine the level and pressure in the vessel 50.

Figure 3:
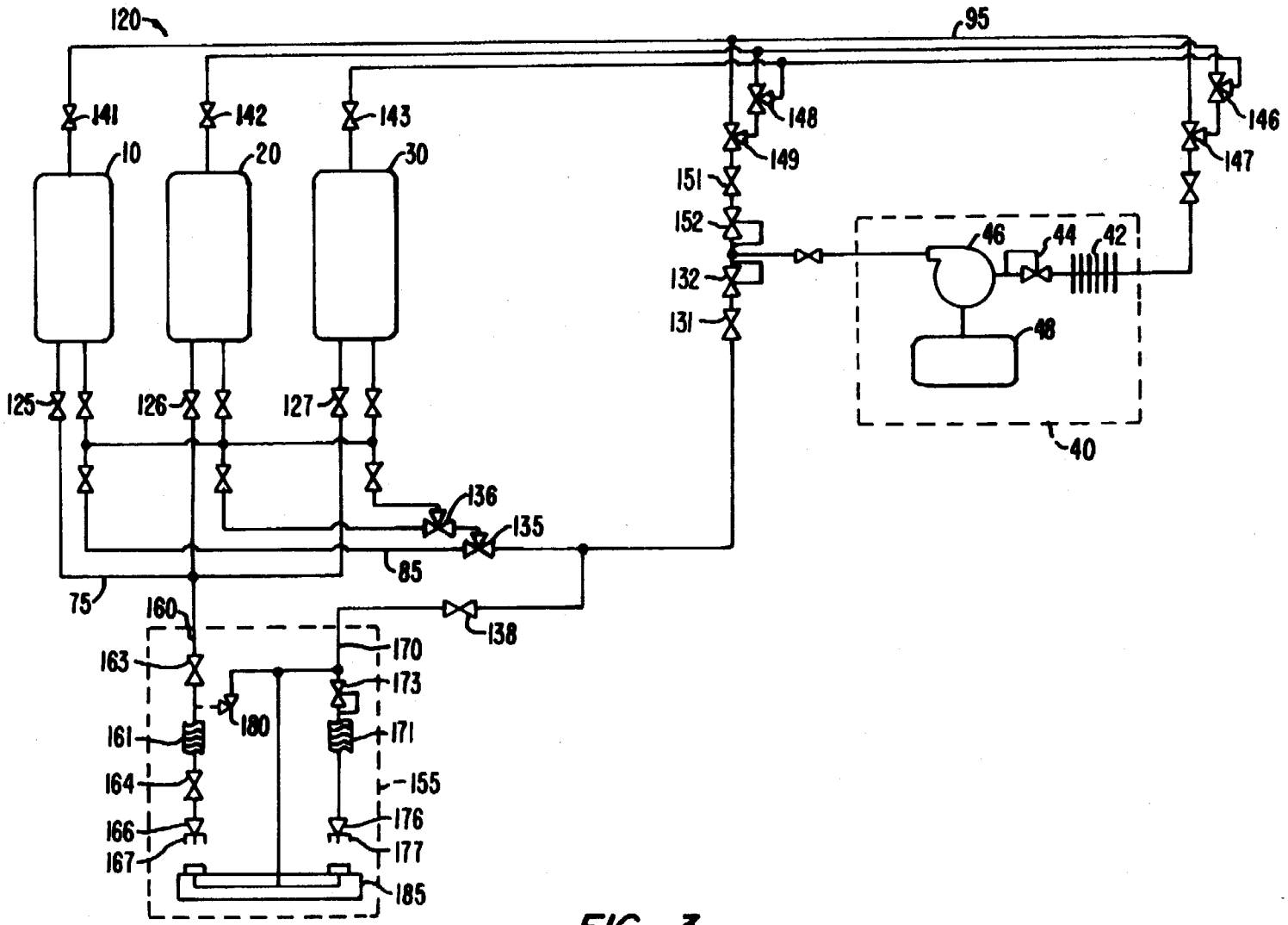
FIG. 3 is a schematic diagram of a fueling station according to the present invention.

FIG. 3 shows schematically a typical configuration of a fueling station according to the present invention. The fueling station 120 includes three cryogenic storage vessels 10, 20, 30, each constructed as described with reference to FIG. 2.

Fueling station 120 also includes compressor 40. Compressor 40 includes a preheater 42, an inlet pressure control regulator 44, a natural gas compressor 46, and an auxiliary storage tank 48. Preheater 42 insures that the temperature of the vapor satisfies the physical requirements of the natural gas compressor 46. Typically, natural gas compressors require vapor to be at a temperature of −25° F. or higher. Other valves and instrumentation may be included as appropriate. Inlet pressure regulator 44 is set to provide natural gas to ten psig to prevent overload of compressor 46. The necessary pressure and temperature given above are typical, and may vary between different fueling stations, but the correct values may be determined by one of skill in the art.

The liquid withdraw ports 70 of each vessel 10, 20, 30 are connected by vacuum insulated pipes to form a liquid withdraw manifold 75. Isolation control valves 125, 126, 127 control the selection of the vessel from which LNG is withdrawn to fuel vehicles.

The bottom fill ports 80 of each vessel are connected to form a low pressure manifold 85. When vapor is being routed from compressor 40 to bubble through a tank, as described with reference to FIGS. 1B and 1C, control valve 131 is opened, valve 138 is closed, and pressure regulator 132 provides natural gas at fifty psig to low pressure manifold 85. Three-way control valves 135, 136 control the selection of the vessel into which the vapor is bubbled.

The top vent ports 90 of each vessel are connected to form a high pressure manifold 95. The vent ports may be closed by valves 141, 142, 143. Furthermore, the manifold lines are connected to three-way control valves 145–149. Control valves 145, 146 control the vessel from which the compressor 40 draws vapor. When vessels are directly pressurized by compressor 40, as described with reference to FIG. 1B, valve 151 is opened, and pressure regulator 152 provides vapor from compressor 40 at up to two-hundred psig. Control valves 148, 149 select the vessel to be pressurized.

The liquid withdraw manifold 75 is connected to a dispenser system 155. The dispenser system 155 includes a fuel line 160 to connect to a vehicle tank. Fuel may be drawn through hose 161 from a dispensing vessel when control valve 163 and pump handle valve 164 are open. A standard one-way safety valve 166 and coupling 167 may be incorporated into the dispenser design to prevent accidental spills. Fuel line 160 in dispenser system 155 also has a meter (not shown) of standard design for measuring the amount of fuel dispensed to a vehicle.

Fueling may be accomplished either by "single" hose or "dual" hose. In a dual hose system, a vent line 170, controlled by backpressure valve 173, can be connected to the vehicle with hose 171 to relieve excess pressure. The vent line is equipped with a one-way safety valve 176 and a coupling 177. A pressure release valve 180 connects the fuel line to the vent line. The vent line 170 is connected to manifold 85. When a vehicle has excess vapor, valve 131 is closed, valve 138 is opened and vapor from the vehicle tank is routed by controls valves 135, 136 to the conditioning tank.

When the hoses 161, 171 are not connected to a vehicle, they may be connected to a dock receptacle 185 to relieve pressure created by atmospheric warming of the LNG remaining in the hose. A second metering device could be incorporated into vent line 170 to measure the amount of returned natural gas vapor. However, the second metering device is not preferred because modern vehicle tank designs do not return much vapor, and therefor the second meter is an unnecessary cost.

It is preferred that in the fueling station of the present invention, the various valves are pneumatically controlled. In such a fueling station, a local control panel shows the electrical solenoid valves which control the pneumatic pressure to each control valve. Since LNG fueling stations are often classified as hazardous areas, many regulating agencies prefer pneumatic controls. Withdraw of the pneumatic control pressure sets all valves to the closed position and thus renders the fueling station "safe". However, the pneumatically controlled valves could be replaced with electrically controlled valves.

It is to be understood that the exact position and nature of the valves and piping may be altered. For example, the three-way valves can be replaced with sets of two-way valves. Valves may be included in, or separated from, the other elements of the fueling station. Various interconnected manifold systems will occur to those of skill in the art. Any such changes are within the scope of the invention.

There is a control system to control the functions, including valve positions and compressor operation, of the fueling station. Preferably, the valves and compressor are controlled by an automatic system. In such a case, the valves will be connected to a computer system in addition to a control panel. However, the fueling station may also be manually controlled, or semi-automatic. A computer system may also carry out inventory management, provide fuel dispensing records, and conduct billing.

The present invention has been described in terms of a preferred embodiment. The invention, however, is not limited to the embodiment depicted and described. Rather, the scope of the invention is defined by the appended claims.

What is claimed is:

1. A method of operating a liquid natural gas fueling station comprising first, second, and third cyrogenic storage vessels, wherein said first vessel contains natural gas vapor and said second and third vessels contain liquid natural gas, comprising:

(a) lowering the vapor pressure in said first vessel by extracting natural gas vapor therefrom, which also lowers the temperature of liquid natural gas, if present, in said first vessel;

(b) conducting said extracted vapor into at least one of the following:

1) said second vessel to pressurize said second vessel;

2) said liquid in said third vessel;

(c) introducing liquid natural gas into said first vessel;

(d) dispensing liquid natural gas from said second vessel; and (e) repeating steps (a) through (d) using said second vessel in steps (a) and (c), said first vessel in step (b2), and said third vessel in steps (b1) and (d).

2. The method of claim 1 wherein liquid natural gas is introduced in step (c) into said first vessel by pressure transfer.

3. The method of claim 2 wherein liquid natural gas is dispensed from said second vessel in step (d) by pressure transfer.

4. The method of claim 3 wherein vapor is extracted from said first vessel in step (a) until the pressure of the natural gas vapor in said first vessel is lowered below fifty psig.

5. The method of claim 4 wherein vapor is extracted from said first vessel in step (a) until the pressure of the natural gas vapor in said first vessel is lowered to about fifteen psig.

6. The method of claim 3 wherein said extracted vapor is conducted in step (b) into the top of said second vessel until said second vessel is pressurized to the pressure required to dispense liquid natural gas therefrom in step (d).

7. The method of claim 6 wherein said extracted vapor is conducted in step (b) into the top of said second vessel until said second vessel is pressurized to above one-hundred and seventy-five psig.

8. The method of claim 6 wherein after said second vessel is pressurized to above one-hundred and seventy-five psig, said extracted vapor is conducted to the liquid in said third vessel after completion of fueling from said first vessel.

9. The method of claim 3 further including the step of venting natural gas vapor from the fuel storage tank of a vehicle into the liquid in said third vessel.

10. The method of claim 3 further including the step of venting natural gas vapor from a tanker into at least one of the following:

the liquid natural gas in said third vessel, or the liquid natural gas in said second vessel.

11. The method of claim 10 wherein said vapor from said tanker is vented into the liquid in said second vessel after the liquid natural gas in said third vessel has reached a saturation pressure of at least fifty psig.

12. A liquid natural gas fueling station for receiving fuel from a tanker and dispensing fuel to a fuel storage tank of a vehicle, comprising:

(a) first, second, and third cryogenic storage vessels for holding liquid natural gas;

(b) a compressor having an inlet and an outlet;

(c) a receiving system including 1) a receiving connection for coupling to the fuel line of said tanker and receiving liquid natural gas from said tanker, and 2) a tanker venting connection for coupling to the vent line of said tanker and receiving natural gas vapor from said tanker;

(d) a dispensing system including 1) a dispensing connection for coupling to the fuel line of said vehicle and dispensing liquid natural gas to said vehicle, and 2) a vehicle venting connection for coupling to the vent line of the vehicle and receiving natural gas vapor from said vehicle; and (e) a manifold system connecting 1) a top port of said first vessel to the inlet of said compressor, and the outlet of said compressor to one of a top port of said second vessel and a bottom port of said third vessel when preparing said second vessel to dispense liquid natural gas and said third vessel to receive liquid natural gas, 2) said dispensing connection to a bottom port of said second vessel and said vehicle venting connection to said bottom port of said third vessel when dispensing liquid natural gas to a vehicle, 3) said receiving connection to a top port of said first vessel and said tanker venting connection to one of said bottom port of said first vessel and the inlet of said compressor when receiving liquid natural gas from a tanker, and the outlet of said compressor to a bottom port of said third vessel if said tanker venting connection is connected to the inlet of said compressor.

13. The fueling station of claim 12 further comprising means for using said second vessel in place of said first vessel, said first vessel in place of said third vessel, and said third vessel in place of said second vessel.

* * * * *